United States Patent [19]

Hay, II

[11] Patent Number: 4,777,800

[45] Date of Patent: Oct. 18, 1988

[54] STATIC HEAD CHARGED HYDRAULIC ACCUMULATOR

[75] Inventor: Donald H. Hay, II, Houston, Tex.

[73] Assignee: Vetco Gray Inc., Houston, Tex.

[21] Appl. No.: 586,178

[22] Filed: Mar. 5, 1984

[51] Int. Cl.[4] ..... F01B 25/02; F01B 31/00

[52] U.S. Cl. ..... 60/593; 92/134; 137/81.2; 137/236.1

[58] Field of Search ..... 60/398, 593, 413; 138/31; 92/134; 137/81.2, 236

[56] References Cited

U.S. PATENT DOCUMENTS

| | | | |
|---|---|---|---|
| 2,193,736 | 3/1940 | Onions | 92/134 |
| 2,554,381 | 5/1951 | Patterson, Jr. | 60/398 |
| 3,436,914 | 4/1969 | Rosfelder | 60/398 |
| 3,669,151 | 6/1972 | Fleming | 138/31 |
| 3,677,001 | 7/1972 | Childers et al. | 137/81.2 |
| 3,987,708 | 10/1976 | Uhrich | 60/413 |
| 4,187,682 | 2/1980 | Shen | 138/31 |
| 4,249,452 | 2/1981 | Brown | 60/582 |

FOREIGN PATENT DOCUMENTS

| | | | |
|---|---|---|---|
| 32112 | 3/1977 | Japan | 138/31 |

*Primary Examiner*—Robert E. Garrett

*Attorney, Agent, or Firm*—Edward L. Kochey, Jr.; James E. Bradley

[57] ABSTRACT

A hydraulic accumulator for subsea use, which charges itself as it is lowered to the operating depth. The seawater and hydraulic fluid operate against unbalanced pistons (36, 52) with low pressure gas (42) therebetween.

4 Claims, 3 Drawing Sheets

STATIC HEAD CHARGED HYDRAULIC ACCUMULATOR

The invention relates to hydraulic accumulators and in particular to accumulators for use in deep water applications.

BACKGROUND OF THE INVENTION

It is usual to operate valves or other mechanisms by the use of hydraulically driven actuators. These are essentially pistons where a hydraulic fluid under pressure is applied to one side of the piston to move the piston and through a linkage to operate the valve. Depending on the resistance of the device to be operated and any pressure which is existing on the opposing side of the piston, a particular minimum pressure level is required for successful operation. Accordingly, where the minimum pressure is in the order of 2200 psi, a pressure range of operation from 3000 to 2200 psi may be used.

In operation, a control valve near the operator is opened in order to permit hydrualic fluid to enter the actuator. As this control valve is opened, the hydraulic fluid at high pressure, which has been existing in the control line upstream of the control valve, flows into the actuator until the piston has been moved as desired.

The hydraulic fluid is normally pressurized at single location, common to the various actuators, by means of a continuously or intermittently operated pump in a system maintaining a high pressure at the source. Where the actuator is located a considerable distance from the source, significant pressure drop will occur in the hydraulic conduit or pipe which is conveying the fluid from the source to the actuator. Accordingly, as the control valve opens to accept hydraulic fluid into the actuator, the flow occurring may be at such a rate as to drop the pressure level at the actuator below that required to operate the actuator. Accordingly, operation of the actuator is delayed to such a time as the pressure can buildup with the fluid being pumped through the hydraulic line.

A conventional method of avoiding this problem is to provide an accumulator near the hydraulic actuator. This accumulator will contain a supply of hydraulic fluid at the preestablished high level. As the pressure level drops to an extent, not exceeding the minimum acceptable, hydraulic fluid is discharged from the accumulator, thereby supplying the required fluid to the actuator immediately. The continued operation of the pump from the source thereafter need only recharge, or refill, the accumulator. Accordingly, much more rapid response of the device to be operated is achieved. Accumulators for this purpose may be simply a supply of hydraulic fluid in a tank under gas pressure or may be a piston operating against a spring.

In the use of subsea actuators, the actuator is not only remote from the hydraulic supply which is at the surface, but there is also a substantial elevation difference, which was ignored in the discussion above. Accordingly, with a pressure such as 3000 psi at the surface, the actual pressure at the actuator will be increased substantially beyond that by the weight or hydrostatic head of the fluid. The actual operating pressure of the accumulator is increased since the opposite side of the piston must discharge the hydraulic fluid either against the static head of a return line or against ambient seawater pressure, where water compatible hydraulic fluid is used. Seawater at a depth of 6700 feet has a static head of about 3000 psi. Accordingly, for an effective operating pressure of 3000 psi, the actual pressure at the actuator, and therefore at the accumulator is actually 6000 psi. It follows that a gas filled accumulator pressurized to 3000 psi at the surface would have the gas compressed to one half the volume at the operating depth. Accordingly, only half the hydraulic fluid would be available, while alternately the accumulator would have to be twice as large.

An accumulator of the type which uses a compressed spring would require that the spring be compressed with an input force equivalent to 6000 psi initially. This becomes an exceedingly large and cumbersome mechanical spring system.

U.S. Pat. No. 3,987,708 entitled "Depth in Sensitive Accumulator For Undersea Hydraulic Systems", teaches a system which uses a conventional gas charged accumulator with the high gas pressure providing the motive force for the accumulator. It is, however, depth compensated by means of a small hydraulic piston having one side open to the ambient, or sea pressure to provide depth compensation. This avoids the problem of the increased compression of the accumulator gas, but still requires that the accumulator be prechanged to full gas pressure at the surface. It also contains extremely high pressure gas which must be sealed over a long period of time.

SUMMARY OF THE INVENTION

The hydraulic system accumulator is designed to discharge its hydraulic capacity at a preselected pressure level, and designed to operate at a preselected depth, for instance, the known depth of a subsea wellhead. Charging of the accumulator at the surface is not required, the charge being developed as the accumulator is lowered to the desired depth.

A piston assembly has a large diameter piston effectively exposed to the ambient pressure of the seawater and a small diameter piston effectively exposed to the hydraulic system pressure. The opposing side of each piston is exposed to contained low pressure gas. The differential area of the pistons causes the accumulator to buildup a predictable unbalanced force against the hydraulic fluid as a function of depth to which the accumulator is lowered. The low pressure gas maintains a relatively low pressure on the opposite sides of the pistons so that the unbalanced force is primarily that between the seawater operating over the large piston and the hydraulic fluid operating over the surface of the small piston. The low pressure gas inherently exerts some opposing force and since it is contained it is compressed as the piston is moved during accumulator operation. The compression of the low pressure gas results in a pressure variation in accordance with the ideal gas law and accordingly provides a proportional range for the accumulator.

A supplementary low pressure volume may be supplied where the initial volume of low pressure gas results in an excessive proportional range of pressure during the stroke of the piston. Furthermore, should it become necessary to use the accumulator at the depth greater than that for which it is designed, a moderate pressurization of the low pressure gas volume to a precalculated level will provide proper action at a greater depth.

A first large diameter cylinder encloses a first chamber with the first large diameter piston slidably and sealingly mounted within the cylinder. This piston divides the first cylinder into an ambient pressure chamber and a low pressure gas chamber. A second small diameter cylinder encloses the second chamber and contains a second small diameter piston slidably and sealingly mounted within this cylinder. It divides the second cylinder into a hydraulic pressure chamber and the low pressure gas chamber. The two low pressure gas chambers are fluidly connected and the pistons are connected to one another so that they move together as a single piston assembly. The ambient pressure of the seawater operating preferably through a transfer barrier exerts the pressure against the large diameter piston in the first direction. The hydraulic pressure of the hydraulic fluid operates against the small piston in an opposite direction. The low pressure gas is contained within the combined low pressure gas chambers.

The small diameter piston is in the form of an elongated hollow cylinder closed at the end adjacent the hydraulic pressure chamber and open at the end adjacent the low pressure gas chamber, whereby the volume of the low pressure gas chamber is effectively increased. Furthermore, the sliding seal action occurs on the outer diameter of the piston which is more easily machined for the high degree of finish required for a sliding seal.

Throughout the life of the actuator the high pressure exists on the fluid side of each piston with the low pressure on the gas side. The seal is against fluid trying to leak into the gas chamber rather than gas trying to leak out, and accordingly the seal may be more effectively maintained throughout the required long life.

Means are provided for moderately pressurizing the low pressure cylinder so that the accumulator may be used at a depth greater than that for which it was designed.

It is an object of the invention to supply a quantity of hydraulic fluid into a hydraulic system upon a predetermined decrease in pressure in that system.

It is a further object to accomplish this without high pressure precharging requirements at the surface and with an apparatus that is relatively small compared to prior art precharged accumulators.

It is a further object to accomplish the percharge at operating depth by simply lowering the accumulator through the seawater to the operating depth.

DESCRIPTION OF THE PREFERRED EMBODIMENT

Figure 1:
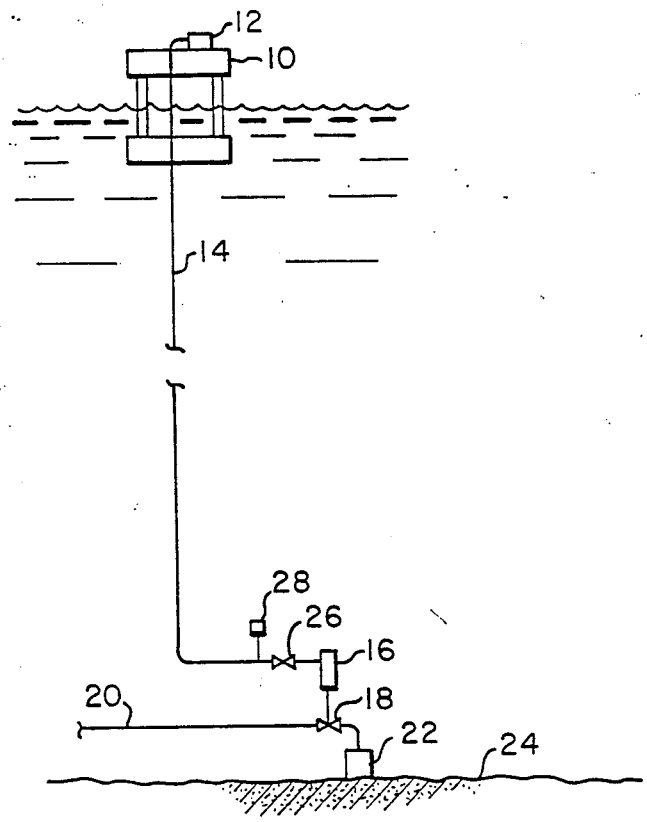
FIG. 1 is a schematic illustrating the relationship of the accumulator to the hydraulic system.

FIG. 1 schematically illustrates a floating platform 10 carrying a pump and hydraulic fluid supply 12, supplying hydraulic fluid through hydraulic line 14 to actuator 16. This actuator controls production valve 18 located in oil flow line 20 from wellhead 22 which is located in the seabed 24. When control valve 26 is opened hydraulic fluid under pressure flows into actuator 16. This causes the pressure to decrease at the lower end of the line because of the flow of hydraulic fluid and the corresponding frictional pressure drop. Accumulator 28 stores a quantity of hydraulic fluid and is arranged to discharge this fluid into hydraulic line 14 over a proportional pressure range, this range being within that required for operation of the actuator 16. Accordingly, as the pressure starts to decrease, discharge from the accumulator supplies the required flow to the actuator until the operation is complete, and continued operation of the pump 12 thereafter increases the hydraulic pressure recharging accumulator 28. Accordingly, the valve (18) to be operated responds quickly despite the long length of hydraulic line 14.

Figure 2:
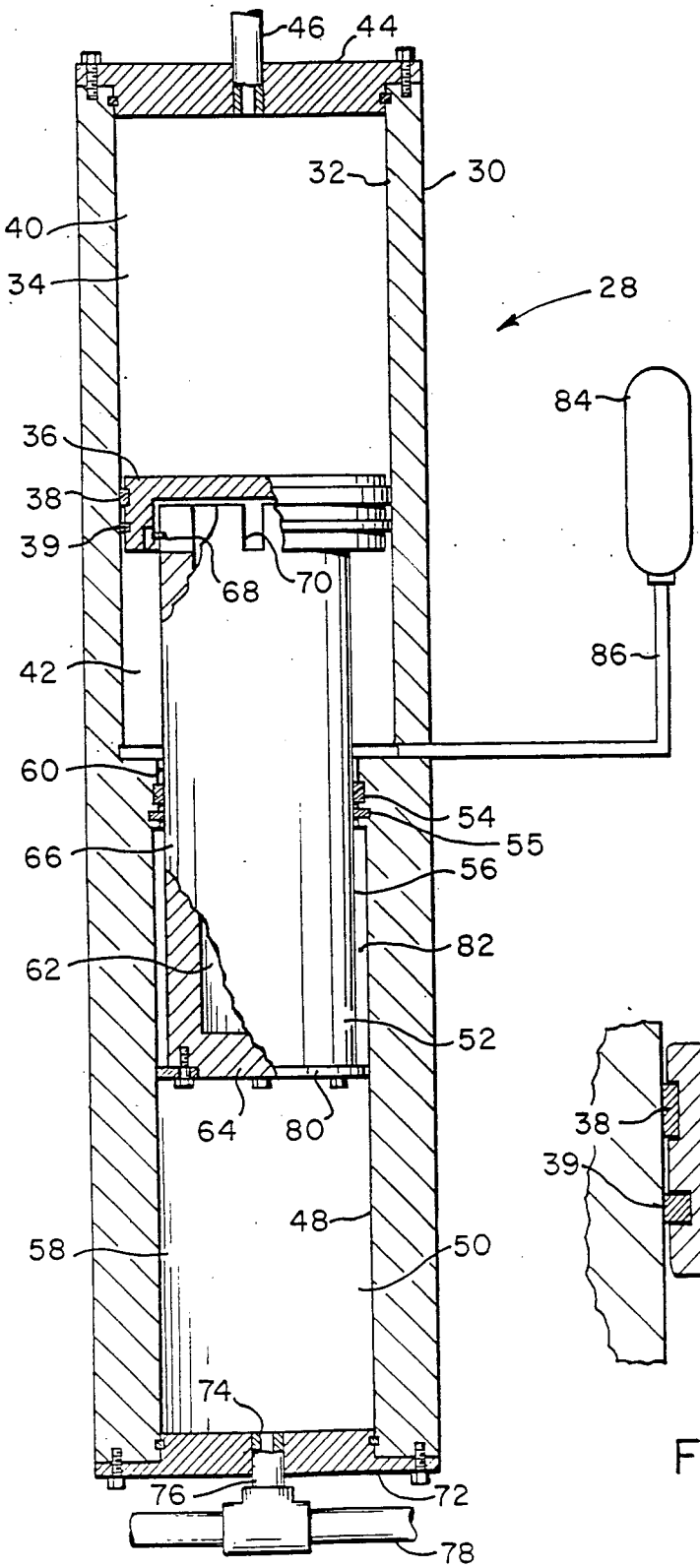
FIG. 2 is a sectional elevation view through the accumulator.
Figure 3:
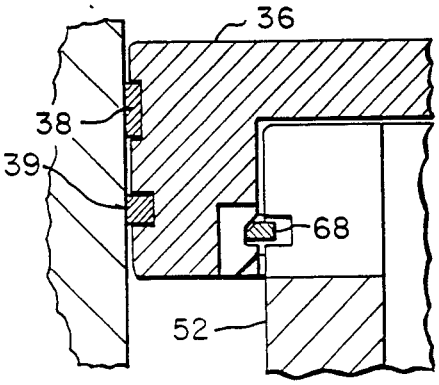
FIG. 3 is a detail showing the upper end of the piston.

Referring to FIG. 2 the accumulator 28 has a housing 30 with the inner surface 32 forming a first large diameter cylinder enclosing a first chamber 34. A first large diameter piston 36 is mounted in the cylinder. Wear ring 38 and sliding seal 39 is secured to the piston and slides along the inner surface 32 of the housing. This seal divides the enclosed chamber into a ambient pressure chamber 40 and a low pressure gas chamber 42.

The anbient pressure cylinder is closed at the end by bolted plate 44 which has an opening 46 therein for connection to ambient sea pressure. Because of the potential corrosion and dirt from direct emission of seawater into the chamber this connection to ambient pressure is preferably made through an interface chamber. Essentially this may comprise a mineral oil within the ambient pressure chamber connected to mineral oil within a separate cylinder, having the surface thereof exposed to seawater. In any event, any interface may be used which permits the pressure of the seawater to move mineral oil into and out of the chamber while preventing the actual seawater itself from reaching the chamber.

At the other end of the housing, interior surface 48 forms a second smaller diameter cylinder enclosing a second chamber 50. A second small diameter piston 52 is mounted within the small diameter cylinder. Wear ring 54 is secured to the housing. The seal 55 is also mounted on the housing and slides against the outer surface 56 of the piston 52.

This piston divides the second chamber 50 into a hydraulic pressure chamber 58 and a low pressure gas chamber 60.

The pistons 36 and 52 are connected to coact and form a piston structure. While this could be accomplished by conventional pistons and a single rod through the center connecting the two it is believed that the particular structure illustrated is advantageous. The piston 52 comprises an elongated hollow cylindrical piston with an interior chamber 62. It is closed by structure 64 at the end adjacent the hydraulic pressure chamber 58. Accordingly, the body 66 of the elongated portion of the piston may be connected by lock ring 68 to the large diameter piston 36. This forms a connection between the two pistons having a large moment of inertia and therefore more resistant to bending and distortion under high forces than would be the case with a center connecting rod. Low pressure gas volume is retained with this structure, since the internal chamber 62 is interconnected through slots 70 to the low pressure chamber 42 of the large diameter cylinder as well as to the small diameter chamber 60 of the small diameter cylinder. It can be seen then that within the housing the low pressure gas occupies chambers 62, 42 and 60 being contained between the seals 39 and 55.

The small diameter chamber 50 is closed at the end by bolted plate 72 having openings 74 therein. A hydraulic conduit 76 connects this opening to the main hydraulic fluid line 78 for which the accumulator capacity is desired.

The small diameter piston 52 also carries at its lower end a centralizing and wear ring plate 80 which is bolted to the piston but has openings around its outer periphery so that the hydraulic fluid may freely enter the space 82.

Figure 5:
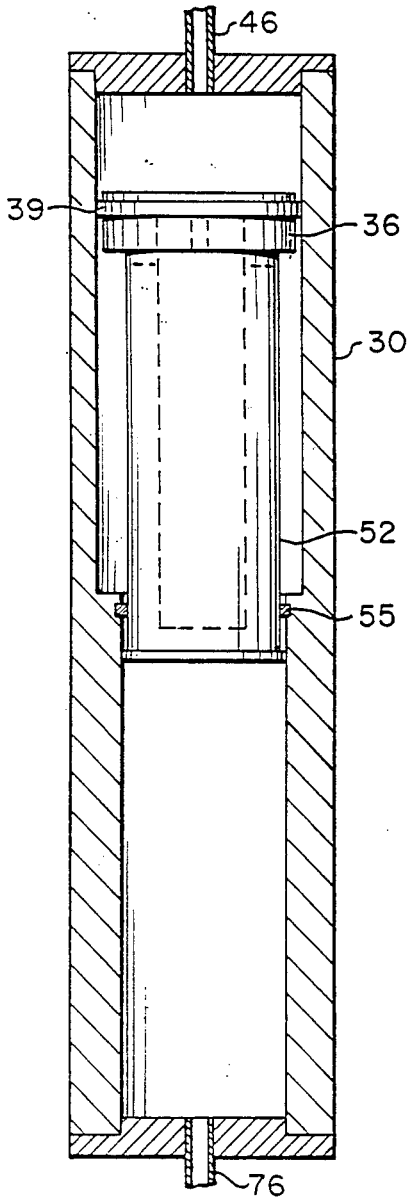
FIG. 5 shows the accumulator fully charged.
Figure 4:
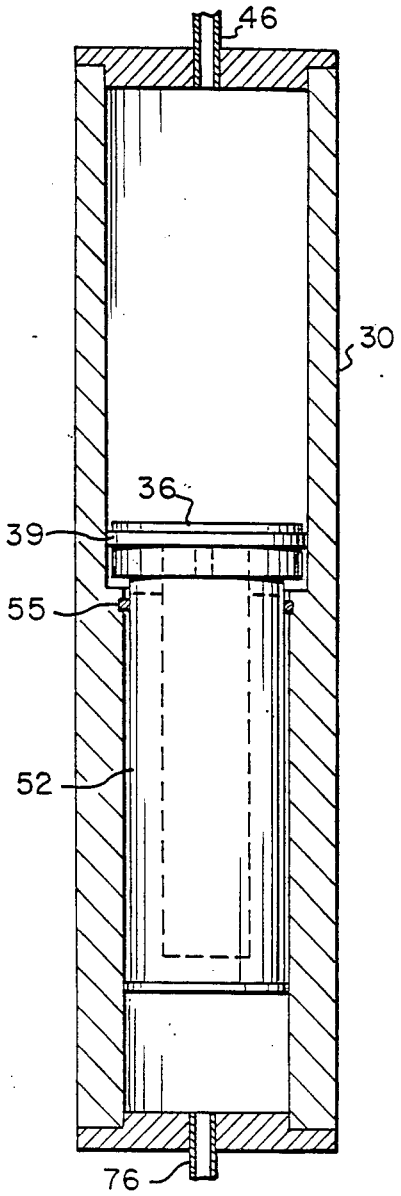
FIG. 4 shows the accumulator fully discharged.

While FIG. 2 illustrates the piston structure and intermediate position, FIG. 4 shows the piston structure in the completely discharged position, while fig. 5 illustrates the completely charged position.

The operation of the accumulator is best understood through a discussion of the forces operating on the piston structure. Furthermore, for initial discussion of the concept it can be assumed that the density of seawater (0.447 psi per foot) and that of the hydraulic fluid (actually 0.433 psi per foot) are the same. The large diameter piston 36 has a force acting downardly on the upper surface of the piston equal to that area times the hydrostatic pressure of the seawater. Similarly, the small diameter piston 52 has an upward force operating equal to the area of that piston times the pressure of the hydraulic fluid. At this time, this pressure is only the hydrostatic pressure of the hydraulic fluid. Operating on each of the pistons, upwardly against piston 36 and downwardly against piston 52, is the internal low gas pressure. Assuming that the static pressure of seawater and hydraulic fluid is the same, the portion of piston 38 area equal to that of piston 52 is effectively cancelled so that the net downward force on the piston assembly is the differential area between the large and small pistons multiplied by the differential of the static pressure of the seawater and the low pressure within the low pressure gas chamber.

If it is therefore desired that the accumulator begin to discharge when the pressure in the hydraulic line is less than 3000 psi above the static head, the area above the piston is selected such that at the desired depth, the force acting on piston 36 due to its differential area (from the small piston) times differential pressure between the static head at the selected depth and the low pressure gas within the accumulator is equal to 3000 psi times the projected area of the piston 52.

In the illustrated embodiment, and using actual densities, the projected area of the large piston is 95.0 inches and that of the small piston is 47.17 square inches. The accumulator is designed to discharge its accumulated supply just below 3000 psi. With the density of seawater of 0.447 psi per foot and 6400 feet depth the resulting pressure is 2861 psi. This operating over the piston area gives a downward force of 271,890 pounds.

The density of the hydraulic fluid of 0.443 psi per foot at 6,400 feet provides a pressure of 2771 psi. This operating over the small diameter piston area of 47.1 inches provides an upward force of 130,718 pounds. The low pressure gas operating on the opposite sides of the piston provides an upward force equal to its pressure times the differential area between the two pistons. Assuming the pressure to be 14.7 psi this provides 703 pounds upward force. The net force on the piston structure is therefore a downward force of 140,469 pounds. This being applied to the area (47.17 square inches) of the small piston provides a pressure equivalent of 2978 psi. Accordingly, this amount of pressure above the static head is required in order to maintain the piston in its upward position in FIG. 5. Any time the pressure in the hydraulic line dropped below this level the piston would tend to move downwardly, discharging the stored hydraulic fluid into the system.

The air pressure of 14.7 psi was selected on the assumption that the actuator was placed with its piston in the position illustrated in FIG. 5 with atmospheric pressure allow to enter while the accumulator was at the surface. Since the air or preferably nitrogen, is enclosed within the chamber this pressure remains the same so long as the piston in its upward position regardless of the depth to which the accumulator may be run. The volume of the low pressure gas space within the accumulator in the illustrated embodiment is 7.29 gallons. As the piston moves from the position illustrated in FIG. 5 to that of FIG. 4, the low gas volume is decreased from 7.29 gallons to 2.225 gallons. The pressure of the gas, therefore, builds up from 14.7 psi to 47.84 psi in accordance with the ideal gas law.

Looking now at FIG. 4 the forces operating on the piston are the same as those discussed before except that the low pressure gas is increased because of compression to 47.84 psi. Accordingly, the resultant pressure instead of being 2978 psi is 2929 psi. It can be seen that while the accumulator begins to discharge at th higher pressure, it is not completely discharged until the lower pressure of 2929 psi is reached. The effect of the low pressure gas and its compression is simply to provide a proportional range throughout which the accumulator operates.

While the proportional range between 2978 psi and 2929 psi is clearly acceptable for the particular requirements discussed; namely, operation between 3000 and 2200 psi, there may be cases where the desired proportional range, or a restricted low pressure gas volume within the accumulator, provides an unacceptably large range. In such a situation, supplementary chamber 84 may be connected by line 86 to the low pressure gas volume thereby increasing it. This increase in the effect of volume of the low pressure gas chambers decreases the differential pressure occurring during compressing of this gas and accordingly decreases the proportional range of the accumulator.

The accumulator discussed above was designed for operation at 6400 feet of depth. Table 1 illustrates the results of calculations made to investigate the ability to use this identical accumulator (without redesign) at alternate depths, using the supplementary chamber 84 as required in certain circumstances.

TABLE 1

| | Ex. 1 | Ex. 2 | Ex. 3 | Ex. 4 | Ex. 5 |
|---|---|---|---|---|---|
| Depth(ft) | 6400 | 4900 | 7000 | 7500 | 7500 |
| ILP(psi) | 14.7 | 14.7 | 264.7 | 514.7 | 514.7 |
| FLP(psi) | 47.84 | 47.84 | 861.5 | 1675.2 | 1317.26 |
| Receiver Volume (gal) | 0 | 0 | 0 | 0 | 1.00 |
| P1(psi) | 2966.2 | 2264.9 | 2993.1 | 2973.2 | 2973.2 |
| P2(psi) | 2932.6 | 2231.3 | 2387.5 | 1795.8 | 2158.9 |

ILP is the initial, at maximum stroke, low pressure in the low pressure region
FLP is the final, at minimum stroke, low pressure in the low pressure region
P1 is the output supply pressure at maximum stroke
P2 is the output supply pressure at minimum stroke Example 1 illustrates the results of the design condition.

Example 2 illustrates the same accumulator used at a depth of only 4900 feet. Since this accumulator becomes charged by the act of lowering it to a design for depth it can be seen that it is insufficiently charged to provide for operation near 3000 psi. However, it will operate at approximately 2250 psi and therefore would be acceptable within the criteria.

Example 3 is an investigation carried out at 7000 feet. Using the initial low pressure of 14.7 psi the accumulator would buildup an excessively high precharge so that it would discharge its contents at pressures well above 3000 psi. Accordingly,, for use at this depth the low pressure gas range must be initially moderately pressurized to 265 psi, thereby providing sufficient counter force against the piston to permit it to start discharging at 2993 psi. Because of the relatively high gas pressure (compared to 14.7 psi) the increase in pressure of low pressure gas during the stroking is substantial and accordingly a rather wide proportional range in the order of 600 psi is encountered. This is still acceptable under the criteria set forth.

Example 4 increases the depth to 7500 feet. This requires an initial gas percharge pressure of 515 psi to offset the excessive depth and it can be seen that with this higher pressure the proportional range is so high that the accumulator is not fully discharged at 2200 psi.

Accordingly, Example 5 illustrates the increase in receiver volume by cutting in supplementary tank 84 to decrease the proportional range. Assuming the additional volume added at 1 gallon, the proportional range is decreased to at least close to the acceptable limit.

It is pointed out that these illustrations of depth other than 6400 feet are all directed to using an accumulator designed for 6400 feet at other depths. The accumulator could be designed for any of the depths without any pressurization required within the low pressure chamber, thereby achieving an operation similar to Example 1 for any depth.

I claim:

1. A hydraulic system accumulator for deep sea use comprising:

a first large diameter cylinder enclosing a first chamber;

a first large diameter piston slidably and sealingly mounted in said cylinder, and dividing said first chamber into an ambient pressure chamber and a low pressure gas chamber;

a second small diameter cylinder enclosing a second chamber;

a second small diameter piston slidably and sealingly mounted in said small diameter cylinder and defining within said chamber a hydraulic pressure chamber;

fluid communication means for fluidly connecting said hydraulic pressure chamber to a main hydraulic line for which accumulator capacity is desired;

said first and second pistons connected to coact and form a piston structure; and the hydraulic pressure of said hydraulic pressure chamber and the ambient pressure of said ambient pressure chamber acting on oppositely outwardly facing sides of the pistons forming said piston structure, the low pressure gas of the low pressure gas chamber acting on any oppositely inwardly facing sides of the pistons forming said piston structure.

2. An accumulator as in claim 1 a supplementary chamber; said supplementary chamber being in fluid communication with said low pressure gas chamber.

3. A hydraulic system accumulator for deep sea use comprising:

a first large diameter cylinder enclosing a first chamber;

a first large diameter piston slidably and sealingly mounted in said cylinder, and dividing said first chamber into an ambient pressure chamber and a low pressure gas chamber;

a second small diameter cylinder enclosing a second chamber;

a second small diameter piston slidably and sealingly mounted in said small diameter cylinder and defining within said chamber a hydraulic pressure chamber;

fluid communication means for fluidly connecting said hydraulic pressure chamber to a main hydraulic line for which accumulator capacity is desired;

said first and second pistons connected to coact and form a piston structure;

the hydraulic pressure of said hydraulic pressure chamber and the ambient pressure of said ambient pressure chamber acting on oppositely outwardly facing sides of the pistons forming said piston structure, the low pressure gas of the low pressure gas chamber acting on any oppositely inwardly facing sides of the pistons forming said piston structure; and said second piston comprising an elongated hollow cylindrical piston closed at the end adjacent said hydraulic pressure chamber, and open at the end adjacent said low pressure gas chamber, whereby the interior of said second piston increases the effective volume of the low pressure gas chambers.

4. An accumulator as in claim 3 first seal means mounted on said first piston for sliding within said first cylinder; and second seal means mounted on said second cylinder for sliding on said second piston.

* * * * *